US008704162B1

(12) United States Patent
Shiohama

(10) Patent No.: US 8,704,162 B1
(45) Date of Patent: Apr. 22, 2014

(54) MASS SPECTROMETER

(71) Applicant: Shimadzu Corporation, Kyoto (JP)

(72) Inventor: Tohru Shiohama, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/724,890

(22) Filed: Dec. 21, 2012

(51) Int. Cl.
*H01J 49/44* (2006.01)

(52) U.S. Cl.
CPC ..... *H01J 49/44* (2013.01)
USPC ..... 250/281

(58) Field of Classification Search
USPC ..... 250/281, 282
See application file for complete search history.

(56) References Cited

U.S. PATENT DOCUMENTS 5,120,957 A * 6/1992 Griffiths ..... 250/282
2007/0203652 A1* 8/2007 Horning et al. ..... 702/19

FOREIGN PATENT DOCUMENTS

JP 2009-129868 A 6/2009

* cited by examiner

*Primary Examiner* — Kiet T Nguyen
(74) *Attorney, Agent, or Firm* — Sughrue Mion, PLLC

(57) ABSTRACT

In a mass spectrometer having an auto-tuning function for sequentially executing parameter adjustments for each part in accordance with a prescribed procedure, a long time is required to tune all of the sections. Therefore, sections which require parameter adjustments are divided into block units, and tuning is executed in a predetermined block order. In each block, tuning is first executed on a representative part of the block, and the result is compared with past tuning results. If the values of both results fall within a prescribed range, the tuning of other sections included in the block is omitted.

2 Claims, 3 Drawing Sheets

MASS SPECTROMETER

The entire contents of Japanese Patent Publication 2011-257333 A are incorporated herein by reference.

BACKGROUND OF THE INVENTION

1. Technical Field

The present invention relates to a mass spectrometer. More particularly, the present invention relates to a mass spectrometer provided with a function for executing auto-tuning.

2. Background Art

In a device such as a mass spectrometer (MS), a gas chromatograph mass spectrometer (GC/MS), or a liquid chromatograph mass spectrometer (LC/MS), it is necessary to maintain the mass resolution or sensitivity at an extremely high level. This is indispensible to allow the performance of the device to be exhibited maximally and is, at the same time, necessary to maintain the reproducibility of analytical results.

Therefore, it is necessary for the voltage applied to each part such as an interface (section for ionizing a liquid sample), an ion guide, a quadrupole voltage, an ion trap, or an ion detector to be respectively kept at the correct level. However, in step with the use of the device and as time passes, deterioration occurs due to factors such as the adherence of the sample to the surface, the oxidation of the surface, or the misalignment of the physical arrangement, which leads to changes in the proper value of the applied voltage. In other words, the mass resolution or sensitivity decreases.

Accordingly, it is desirable to periodically perform tuning to adjust various parameters such as the voltages applied to electrodes to optimal values using a standard substance with known constituent types or concentrations at a frequency of approximately once per month and at least approximately once every six months, for example. Although tuning was previously performed as a manual procedure, in recent years it is common for devices to be equipped with an auto-tuning function for performing tuning automatically (for example, see Patent Literature 1).

When performing auto-tuning, a detector is ordinarily tuned first. Next, the adjustment of the sensitivity or resolution of each part is executed. In each of these adjustment modes, adjustment ordinarily begins from the inlet of the device and sequentially proceeds toward the later stages.

Tuning is performed with a method of searching for a value for which the output is maximized while varying the voltage applied to each section. In conventional auto-tuning, tuning is performed for all sections in this way from start to finish within a range designated by the user.

PRIOR ART LITERATURES

PATENT LITERATURE 1) Japanese Unexamined Patent Application Publication 2009-129868

SUMMARY OF THE INVENTION

Sections to be tuned increase in number as the device becomes increasingly complex. Therefore, a long time may be required for the entire tuning process to be completed.

The present invention was conceived in order to solve the problem described above, and its purpose is to provide a mass spectrometer equipped with an auto-tuning function for automatically performing parameter adjustments for each part of the device so as to enable the reduction of the time required for auto-tuning without reducing the tuning precision.

The mass spectrometer of the present invention, which was conceived based on the ideas described above, is a mass spectrometer having an auto-tuning function for sequentially executing parameter adjustments for each part in accordance with a prescribed procedure, the mass spectrometer comprising: a tuning result storage part which stores past tuning results for at least each representative part respectively set for a plurality of blocks constituting the mass spectrometer; and a tuning target control part which executes tuning in a predetermined block order based on the receipt of an instruction to execute auto-tuning, wherein, for each block, the tuning target control part first performs tuning for a representative part of the block, compares the result with corresponding past tuning results stored in the tuning result storage part, and omits the tuning of each of the other parts of the block if both values fall within a prescribed range or executes tuning for each of the other parts of the block if both values are outside the prescribed range.

The mass spectrometer of the present invention preferably further comprises a comparison result selection part which allows a user to select desired tuning results from among a plurality of past tuning results stored in the tuning result storage part.

In the present invention, a mass spectrometer includes all forms of mass spectrometers which require tuning for each part constituting the device. Representative devices include mass spectrometers (MS), gas chromatograph mass spectrometers (GC/MS), liquid chromatograph mass spectrometers (LC/MS), and configurations involving a plurality of stages of MS (MSn), but the present invention is not, of course, limited to these examples. In the case of a configuration in which a sample adjustment part (GC or LC) is provided at a preliminary stage and an analysis part (MS) is provided at a subsequent stage, as in the case of GC/MS or LC/MS, the preliminary and subsequent stages may be combined to form the mass spectrometer of the present invention, and the subsequent stage alone may also be used as the mass spectrometer of the present invention.

In the mass spectrometer of the present invention, the mass spectrometer is divided into a plurality of blocks. When executing tuning, instead of adjusting all sections, tuning is first performed on a representative part of each block, and the tuning result is compared with results for comparison stored in the tuning result storage part. If the difference between the values is within a prescribed range, it is assessed that tuning is unnecessary for that block, and the tuning of the other sections of the block is omitted. On the other hand, if the difference between the values does not fall within the prescribed range, it is assessed that tuning is necessary for that block, and tuning is sequentially executed for the other sections of the block.

Accordingly, with the mass spectrometer of the present invention, it is possible to reduce the amount of time required for the tuning of the entire device while maintaining the reliability of tuning itself.

In addition, since providing a comparison result selection part allows the user to select results for comparison from past results, it is possible to set the tuning level with a high degree of freedom.

DESCRIPTION OF THE EXEMPLARY EMBODIMENTS

A GC/MS serving as an embodiment of the mass spectrometer of the present invention will be described hereinafter with reference to the drawings. The GC/MS of this embodiment is provided with an auto-tuning function for various parameters using the adjustment method of the mass spectrometer of the present invention.

Figure 1:
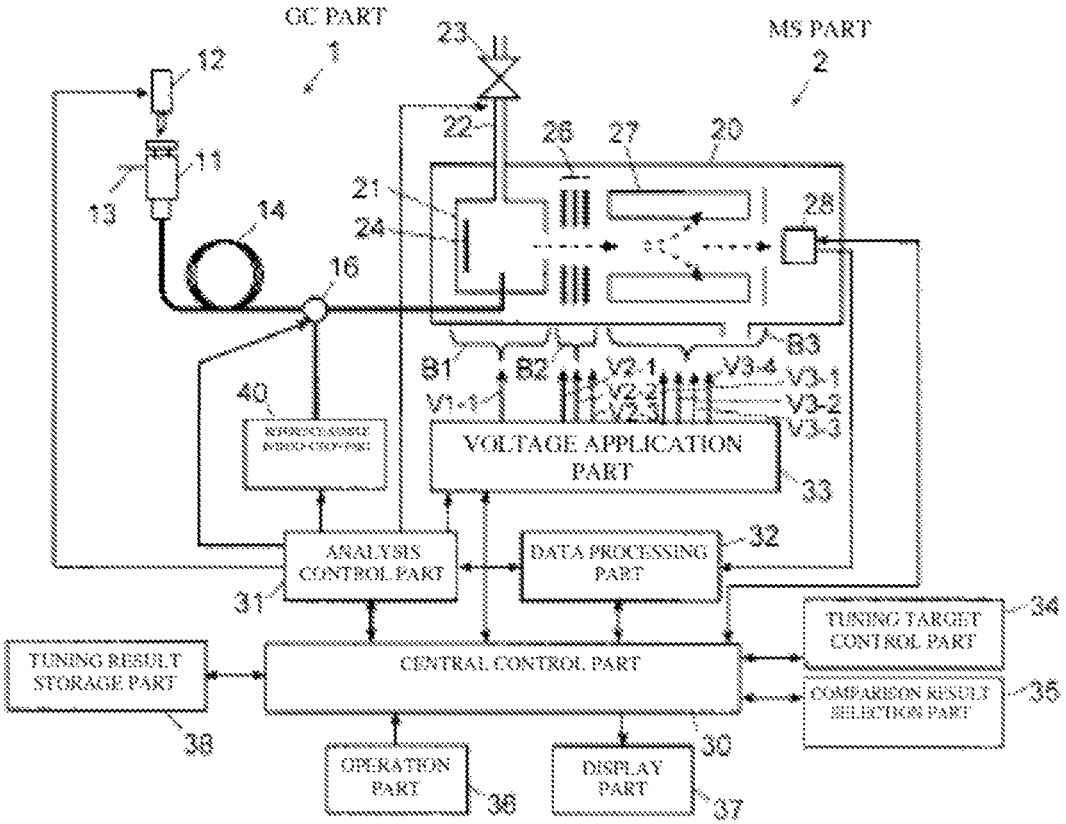
FIG. 1 is a schematic diagram of the relevant parts of a GC/MS serving as an embodiment of the present invention.

FIG. 1 is a schematic diagram of the relevant parts of the GC/MS of this embodiment. In a GC part 1, a sample vaporizing chamber 11 is provided on the inlet end of a capillary column 14 disposed inside a column oven not shown in the drawing, and a carrier gas such as He supplied to the sample vaporizing chamber 11 from a carrier gas channel 13 at a roughly constant flow rate is sent to the capillary column 14. When a small amount of a liquid sample is dripped into the heated sample vaporizing chamber 11 by an injector 12 at the time of analysis, the liquid sample is immediately vaporized and is carried by the carrier gas flow so as to be fed to the capillary column 14. The sample constituents carried by the carrier gas flow are separated and eluted in the time direction when they pass through the capillary column 14 and are sent to an MS part 2 via a channel switching part 16.

In the MS part 2, an ionization chamber 21, a lens electrode 26, a quadrupole mass filter 27, and a ion detector 28 are disposed inside a vacuum chamber 20 which is vacuum-evacuated by a vacuum pump not shown in the drawing. A sample gas channel 22 provided with a valve 23 is connected to an intermediate position of the ionization chamber 21, and a repeller electrode 24 is disposed on the inside. Although not shown in the drawing, a filament is attached to the ionization chamber 21, and thermal electrons produced by the filament are fed into the ionization chamber 21. When ionization is performed inside the ionization chamber 21, the valve 23 is opened so that a sample gas (methane, for example) is supplied into the ionization chamber 21, and thermal electrons make contact with the gas so that the sample gas is ionized. The sample gas ions and the sample molecules cause a chemical reaction which produces sample molecule ions, and the produced ions are extruded in the right direction in FIG. 1 from inside the ionization chamber 21 by the action of an electric field formed by a repeller voltage applied to the repeller electrode 24 from a voltage application part 33.

The ions emerging from the ionization chamber 21 are converged and, in some cases, accelerated by the action of an electric field formed by the lens electrode 26 and fed to the quadrupole mass filter 27. A voltage formed by multiplexing a direct current voltage and a high-frequency voltage is applied to the quadrupole mass filter 27, and only ions having a mass-to-charge ratio (m/z) corresponding to this voltage selectively pass through the filter 27 and reach the ion detector 28. By varying the voltage applied to the quadrupole mass filter 27 with a prescribed pattern, it is possible to scan the mass-to-charge ratios of ions passing through the filter 27 within a prescribed range. A detection signal provided by the ion detector 28 is inputted into a data processing part 32, where a mass spectrum is created and quantitative and qualitative analyses are executed. The channel switching part 16 switches channels so that a prescribed reference sample prepared in a reference sample introduction part 40 is introduced into the ionization chamber 21 at the time of automatic adjustment described below. An analysis control part 31 controls each part in order to perform analysis or automatic adjustment. A central control part 30 to which an operation part 36 or a display part 37 is connected provides instructions to the analysis control part 31 and the data processing part 32 so as to execute integrated control over each part in accordance with predetermined control programs, and the analysis results and the like are displayed by the display part 37. The functions of the central control part 30 or the data processing part 32 can be realized by executing prescribed control/processing programs on a general-purpose personal computer. A tuning target control part 34 similarly has a configuration which is realized by software on this personal computer.

Past tuning results are respectively stored is stored in a tuning result storage part 38 for at least each representative part of a plurality of blocks constituting the mass spectrometer. In the MS part 2 of this embodiment, three blocks are set—a first block B1 corresponding to the repeller electrode 24, a second block B2 corresponding to the lens electrode 26, and a third block B3 corresponding to the quadrupole mass filter 27.

Only one section (that is, a first block/first voltage application section V1-1) for which parameters are to be adjusted is included in the first block B1. Accordingly, this first block/first voltage application section V1-1 is set as the representative part of the first block B1.

Three sections (a second block/first voltage application section V2-1, a second block/second voltage application section V2-2, and a second block/third voltage application section V2-3) for which parameters are to be adjusted are included in the second block B2. Of these, the second block/first preliminary voltage application section V2-1, which is closes to the inlet side and farthest from the detector 28, is set as the representative part of the second block B2.

Four sections (a third block/first voltage application section V3-1, a third block/second voltage application section V3-2, a third block/third voltage application section V3-3, and a third block/fourth voltage application section V3-4) for which parameters are to be adjusted are included in the third block B3. Of these, the third block/first voltage application section V3-1, for which parameter adjustments are performed first in the third block B3, is set as the representative part of the third block B3.

It is ordinarily desirable for the adjustment sections which are set as the representative parts of each of the blocks to be the sections for which parameters are adjusted first in the blocks.

Figure 2:
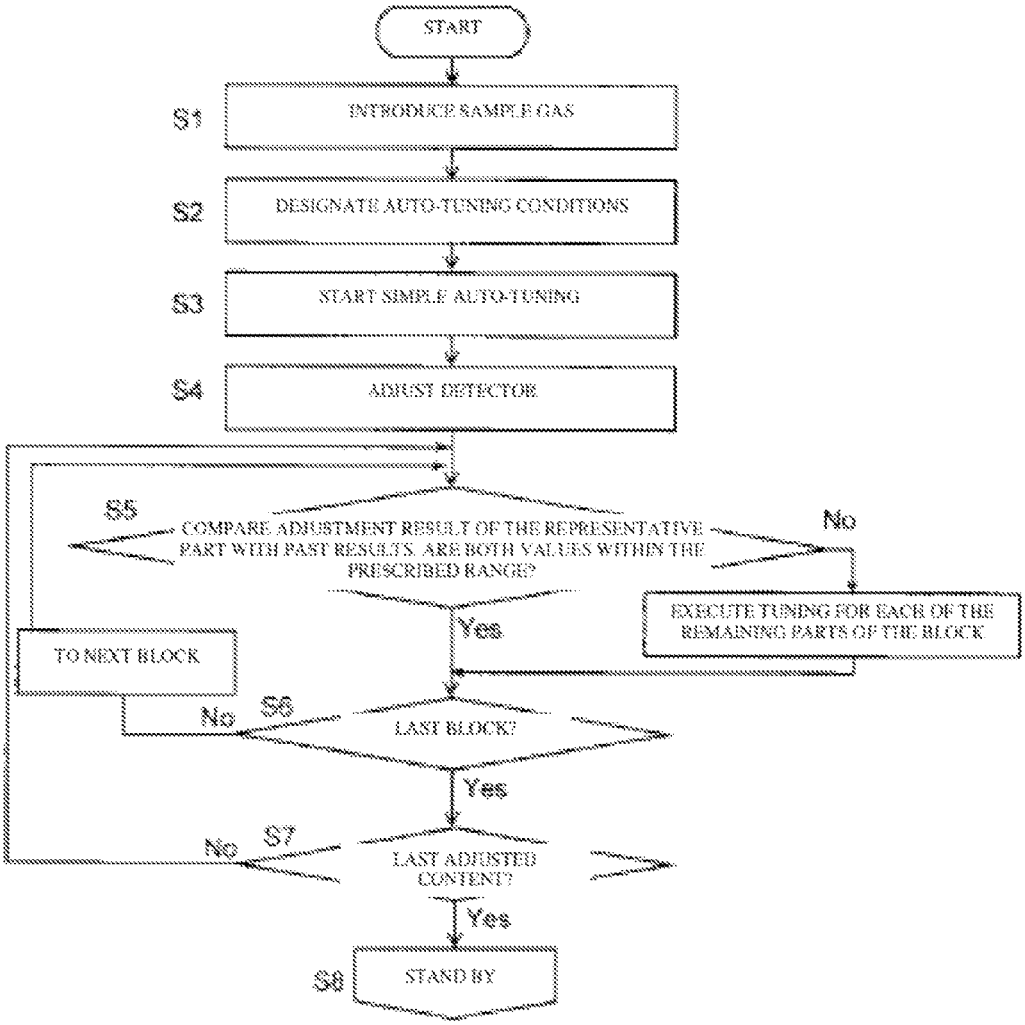
FIG. 2 is a flowchart showing the characteristic control/processing for adjusting various parameters of the MS part in the GC/MS of this embodiment.

Next, the characteristic control/processing executed when adjusting various parameters in the GC/MS of this embodiment will be described using the flowchart of FIG. 2.

First, the valve 23 is opened under the control of the analysis control part 31, and methane gas, for example, serving as a sample gas is supplied into the ionization chamber 21 through the sample gas channel 22 (step S1). Since the inside of the vacuum chamber 20 is vacuum-evacuated, the inside of the ionization chamber 21 is maintained at roughly constant gas conditions due to the efflux of methane from the ionization chamber 21 to the outside. Next, the person in charge of analysis orders the execution of auto-tuning after inputting the auto-tuning conditions with the operation part 36 on a setting screen such as that shown in FIG. 3, for example (step S2). The central control part 30 initiates the auto-tuning function in response to this instruction (step S3).

Here, the setting screen shown in FIG. 3 will be described. On this setting screen, the item called "simple execution" is checked. This is an item for ordering the simple execution of auto-tuning, which is a characteristic configuration of the mass spectrometer of the present invention. On the right side of the simple execution item is a field from which a file can be selected, and "20100101 tuning results" is shown in this field. This is based on the operation of a comparison result selection part 35. The comparison result selection part 35 allows the user to select the desired results from among one or a plurality of past tuning results stored in the tuning result storage part 38. The past tuning results include, for example, arbitrary stages beginning with the settings at the time of the purchase of the mass spectrometer for example.

Next, in step S4, the detector 28 is adjusted. This is an operation based on the fact that the item "detector adjustment" is checked on the setting screen shown in FIG. 3.

Next, the sensitivity is adjusted in step S5. This is an operation based on the fact that the item "sensitivity adjustment" is checked on the setting screen shown in FIG. 3.

In a state in which no reference sample is introduced into the ionization chamber 21, a search is first performed for a voltage value at which the signal intensity is maximized while gradually changing the repeller voltage applied to the first block/first voltage application section V1-1 (repeller electrode 24) serving as the representative part of the first block B1 by the voltage application part 33 within a prescribed range (for example, −1 to 3 V) with respect to the repeller electrode 24.

Next, in a state in which the repeller voltage is fixed to the voltage value determined in this way, a search is performed for a voltage value at which the signal intensity is maximized while gradually changing the voltage applied to the second block/first voltage application section V2-1 by the voltage application part 33 within a prescribed range with respect to the second block/first voltage application section V2-1 serving as the representative part of the second block B2.

When the voltage value at which the signal intensity is maximized is determined, this value is compared with the corresponding past tuning results stored in the tuning result storage part designated by the user. If both values fall within a prescribed range (Yes in step S5), tuning is not executed for each of the other parts (the second block/second voltage application section V2-2 and the second block/third voltage application section V2-3) of this second block B2. This is based on the idea that when both values fall within a prescribed range, omitting the tuning of the other sections of the block does not affect the overall tuning precision.

On the other hand, if both values do not fall within the prescribed range (No in step S5), tuning is executed for each of the remaining parts (that is, the second block/second voltage application section V2-2 and the second block/third voltage application section V2-3) of the second block B2.

Next, in step S6, it is assessed whether the second block is the last block. In this embodiment, the third block is the last block, so an assessment of "No" is given. As a result, the representative part of the third block is adjusted (the process returns to step S5). This parameter adjustment is executed while fixing the voltage value based on the results obtained previously for each part of the first block B1 and the second block B2. Specifically, a search is performed for a voltage value at which the signal intensity is maximized while gradually changing the voltage applied to the third block/first voltage application section V3-1 serving as the representative part of the third block B3 by the voltage application part 33 within a prescribed range with respect to the third block/first voltage application section V3-1.

When the voltage value at which the signal intensity is maximized is determined, this value is compared with the corresponding past tuning results stored in the tuning result storage part designated by the user. If both values fall within a prescribed range (Yes in step S5), tuning is omitted without being executed for each of the other parts (the third block/second voltage application section V3-2, the third block/third voltage application section V3-3, and the third block/fourth voltage application section V3-4) of this third block B3. If both values do not fall within a prescribed range (No in step S5), tuning is respectively executed for each of the remaining parts (that is, the third block/second voltage application section V3-2, the third block/third voltage application section V3-3, and the third block/fourth voltage application section V3-4) of the third block B3.

Figure 3:
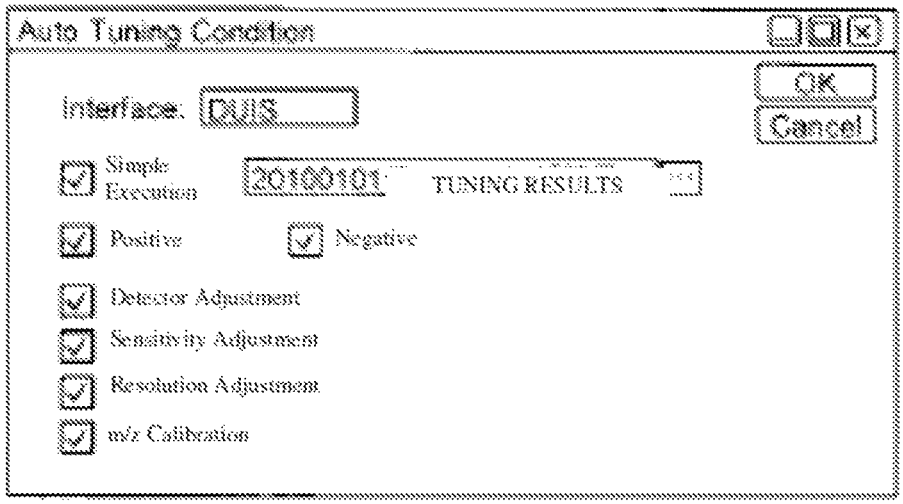
FIG. 3 is an example of a simple tuning setting screen in an embodiment of the present invention.

The process once again returns to step S6, and if it is assessed that the block is the last block (Yes), the process proceeds to step S7, where it is assessed whether yet another adjustment has been ordered on the setting screen shown in FIG. 3. In the case of this embodiment, the resolution adjustment and m/z calibration are similarly executed thereafter. The device then waits until an instruction for analysis or the like is given (step S8).

As described above, in the mass spectrometer of the present invention, the sections to be tuned can be omitted as necessary by comparing results with the past tuning results stored in the tuning result storage part 38. Accordingly, it is possible to reduce the amount of time required for auto-tuning while maintaining the precision of tuning itself to a certain degree.

The embodiment described above is one example of the present invention, and it is obvious that adjustments or modifications can be made appropriately within the scope of the gist of the present invention.

EXPLANATION OF REFERENCES

1 . . . GC part
11 . . . sample vaporizing chamber
12 . . . injector
13 . . . carrier gas channel
14 . . . capillary column
16 . . . channel switching part
2 . . . MS part
20 . . . vacuum chamber
21 . . . ionization chamber
22 . . . sample gas channel
23 . . . valve
24 . . . repeller electrode
26 . . . lens electrode
27 . . . quadrupole mass filter
28 . . . ion detector
30 . . . central control part
31 . . . analysis control part
32 . . . data processing part
33 . . . voltage application part
34 . . . tuning target control part
35 . . . comparison result selection part
36 . . . operation part
37 . . . display part
38 . . . tuning result storage part
40 . . . reference sample introduction part

What is claimed is:

1. A mass spectrometer having an auto-tuning function for sequentially executing parameter adjustments for each part in accordance with a prescribed procedure, said mass spectrometer comprising:

a tuning result storage part which stores past tuning results for at least each representative part respectively set for a plurality of blocks constituting said mass spectrometer; and a tuning target control part which executes tuning in a predetermined block order based on the receipt of an instruction to execute auto-tuning, wherein, for each block, said tuning target control part first performs tuning for a representative part of the block, compares the result with corresponding past tuning results stored in said tuning result storage part, and omits the tuning of each of the other parts of the block if both values fall within a prescribed range or executes tuning for each of the other parts of the block if both values are outside the prescribed range.

2. The mass spectrometer according to claim 1, further comprising a comparison result selection part which allows a user to select desired tuning results from among a plurality of past tuning results stored in said tuning result storage part.

* * * * *